US006915772B2

(12) United States Patent
Carpenter

(10) Patent No.: US 6,915,772 B2
(45) Date of Patent: Jul. 12, 2005

(54) AUTOMATIC PRIMING SYSTEM

(75) Inventor: Todd L. Carpenter, Gregory, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/658,063

(22) Filed: Sep. 9, 2003

(65) Prior Publication Data

US 2004/0103864 A1 Jun. 3, 2004

Related U.S. Application Data

(60) Provisional application No. 60/412,154, filed on Sep. 19, 2002.

(51) Int. Cl.[7] ..... F02M 1/08; F02M 1/10

(52) U.S. Cl. ..... 123/179.12; 123/179.13

(58) Field of Search ..... 123/179.7, 179.9, 123/179.12, 179.13, 179.14, 179.15, 179.16

(56) References Cited

U.S. PATENT DOCUMENTS

| | | | | |
|---|---|---|---|---|
| 1,365,755 A | | 1/1921 | Waterhouse | |
| 1,693,732 A | | 12/1928 | Stokes | |
| 4,394,852 A | * | 7/1983 | Tuckey et al. | 123/179.9 |
| 4,457,271 A | * | 7/1984 | Fitch | 123/179.12 |
| 5,626,118 A | | 5/1997 | Sugii | 123/439 |
| 6,152,431 A | | 11/2000 | Stenz et al. | 261/34.1 |
| 6,186,117 B1 | | 2/2001 | Matte | 123/437 |
| 6,286,469 B1 | | 9/2001 | Cobb, Jr. | 123/73 C |

* cited by examiner

*Primary Examiner*—Andrew M. Dolinar
(74) *Attorney, Agent, or Firm*—Baker & Daniels

(57) ABSTRACT

An automatic priming system for internal combustion engines, which is operable at engine cranking speeds and which is automatically disabled at engine running speeds. The automatic priming system is driven by pressure fluctuations within the engine crankcase which are caused by reciprocation of the piston. At engine cranking speeds, fluid communication between the engine crankcase and a chamber is substantially equalized, such that positive pressure pulses from the crankcase air space pass from the chamber through a check valve to the carburetor for priming. At engine running speeds, communication between the crankcase air space and the chamber is restricted such that the pressure within the chamber is below atmospheric, positive pressure pulses are not present within the chamber, and the priming function is automatically disabled.

25 Claims, 10 Drawing Sheets

AUTOMATIC PRIMING SYSTEM

CROSS REFERENCE TO RELATED APPLICATIONS

This application claims the benefit under Title 35, U.S.C. § 119(e) of U.S. Provisional Patent Application Ser. No. 60/412,154, entitled AUTOMATIC PRIMING SYSTEM, filed on Sep. 19, 2002.

BACKGROUND OF THE INVENTION

1. Field of the Invention

The present invention relates to small internal combustion engines of the type used with lawn mowers, lawn and garden tractors, snow throwers and other working implements, or with small sport vehicles. Particularly, the present invention relates to a priming system to aid in starting such engines.

2. Description of the Related Art

Small internal combustion engines typically include a carburetor which mixes liquid fuel with atmospheric air drawn through the carburetor to provide an air/fuel combustion mixture to the engine. One type of carburetor commonly used in small engines includes a throat with a venturi through which air is drawn, and into which fuel is drawn for mixing with the intake air, as well as a fuel bowl disposed beneath the throat in which a quantity of liquid fuel is stored. A float valve in the fuel bowl meters a supply of fuel thereinto from a main fuel tank as necessary as the fuel in the fuel bowl is consumed.

Additionally, such carburetors typically include a manually operable priming feature, such as a priming bulb which is pressed by an operator to pressurize the air space above the fuel in the fuel bowl, thereby forcing a quantity of priming fuel from the fuel bowl into the carburetor throat for mixing with the intake air which is drawn into the carburetor. The priming fuel is in excess of the amount of fuel which is normally supplied for mixing with the intake air to form the combustion mixture, such that a rich air/fuel mixture is initially supplied to the engine to aid in engine starting. After the engine starts, the priming fuel is consumed, and mixing of the air/fuel mixture is thereafter controlled by the fuel metering system of the carburetor during running of the engine.

The foregoing priming feature for carburetors requires an operator to manually press the priming bulb to prime the engine. If the operator does not press the bulb enough times, or if the operator fails to press the priming bulb altogether, pressure will not be built up within the fuel bowl of the carburetor to the extent necessary to supply priming fuel to aid in engine starting. Therefore, difficulty may be encountered in starting the engine. Conversely, if the priming bulb is pressed by an operator too many times, an undesirably large amount of priming fuel may be supplied, which could flood the engine.

Additionally, many carburetors for small engines also include a choke feature, such as a choke valve, which is manually actuated by the operator during engine starting to further enrich the air/fuel mixture initially supplied to tile engine. However, until the choke feature is manually deactivated by the operator, the carburetor will continue to supply an enriched air/fuel mixture to the engine after the engine has started, which could flood the engine. Therefore, the operator must remember to deactivate the choke feature after the engine begins to run in order to prevent the engine from flooding.

It is desirable to provide a priming system for use in small internal combustion engines having carburetors which is an improvement over the foregoing.

SUMMARY OF THE INVENTION

The present invention provides an automatic priming system for internal combustion engines, which is operable at engine cranking speeds, and which is automatically disabled at engine running speeds. The automatic priming system is driven by pressure fluctuations within the engine crankcase which are caused by reciprocation of the piston. At engine cranking speeds, fluid communication between the engine crankcase air space and a chamber is substantially equalized, such that positive pressure pulses from the crankcase pass from the chamber through a check valve to the carburetor for priming. At engine running speeds, communication between the crankcase and the chamber is restricted such that the pressure within the chamber is below atmospheric, positive pressure pulses are not present within the chamber, and the priming function is automatically disabled.

In one embodiment, a restrictor is provided between the crankcase and the chamber. At engine cranking speeds, the pressure fluctuations within the crankcase do not occur rapidly enough for the restrictor to restrict fluid communication of the pressure fluctuations between the crankcase and the chamber, such that the pressures in the crankcase and the chamber may substantially equalize. In this manner, positive pressure pulses are supplied to the carburetor from the chamber through the check valve for priming. At engine running speeds, the pressure fluctuations within the crankcase occur very rapidly, and the restrictor restricts full communication thereof to the chamber such that the pressure in the chamber does not exceed atmospheric pressure. Therefore, no positive pressure pulses are supplied to the carburetor at engine running speeds, and the priming function is disabled.

Advantageously, because the automatic priming system is driven by pressure pulses from the engine crankcase which are generated by reciprocation of the piston, as controlled by the restrictor, chamber, and check valve, the automatic priming system does not require manual priming of the carburetor or manual operation of a choke feature of the carburetor to prime the carburetor for engine starting and to disable the priming function when the engine reaches running speed.

Further, the present automatic priming system may include a low oil shutdown feature which disables running of the engine when the oil level in the crankcase drops below a level in which damage to the engine could potentially occur. When the oil level drops below a desired level during running of the engine, positive pressure pulses are freely communicated into the chamber, and from the chamber to the fuel bowl of the carburetor, thereby pressurizing the air space in the fuel bowl to supply and overly rich air/fuel mixture to the engine and causing the engine to stall.

In one form thereof, the present invention provides an internal combustion engine, including an engine housing including a crankcase and a cylinder; a crankshaft, connecting rod, and piston assembly disposed within the engine housing, the piston reciprocable within the cylinder to generate positive and negative pressure pulses within the crankcase during cranking and running speeds of the engine; a carburetor attached to the engine housing; and a priming system, including a chamber in fluid communication with the crankcase through a restrictor, the chamber also in fluid communication with the carburetor through a one-way valve permitting fluid flow from the chamber to the carburetor, the restrictor dimensioned to allow substantially uninhibited communication of pressure pulses between the crankcase and the chamber at engine cranking speeds and to dampen communication of pressure pulses between the crankcase and the chamber at engine running speeds; whereby at engine cranking speeds, positive pressure pulses may pass from the chamber to the carburetor through the one-way valve, and at engine running speeds, the positive pressure pulses are substantially absent within the chamber.

In another form thereof, the present invention provides an internal combustion engine, including an engine housing including a crankcase and a cylinder; a crankshaft, connecting rod, and piston assembly disposed within the engine housing, the piston reciprocable within the cylinder to generate positive and negative pressure pulses within the crankcase during cranking and running speeds of the engine; a carburetor attached to the engine housing; and a priming system, including a chamber in fluid communication with the crankcase, the chamber also in fluid communication with the carburetor; a check valve disposed between the chamber and the carburetor, the check valve permitting fluid flow from the chamber to the carburetor and preventing fluid flow from the carburetor to the chamber; and means for allowing substantial pressure equalization between the crankcase and the chamber at engine cranking speeds such that positive pressure pulses may pass from the chamber through the check valve to the carburetor for priming, and for preventing substantial pressure equalization between the crankcase and the chamber at engine running speeds such that positive pressure pulses are not present within the chamber.

In another form thereof, the present invention provides a method of operating an internal combustion engine, including the steps of cranking a crankshaft, connecting rod, and piston assembly of the engine to reciprocate the piston within a cylinder and to generate positive and negative pressure pulses within a crankcase of the engine; allowing substantially uninhibited fluid communication during cranking between the crankcase and a chamber in fluid communication with the crankcase; during cranking, conducting positive pressure pulses from the chamber to the carburetor for priming while preventing passage of negative pressure pulses from the chamber to the carburetor; starting the engine; and subsequent to starting the engine, preventing substantially the passage of positive pressure pulses from the chamber to the carburetor.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 1:
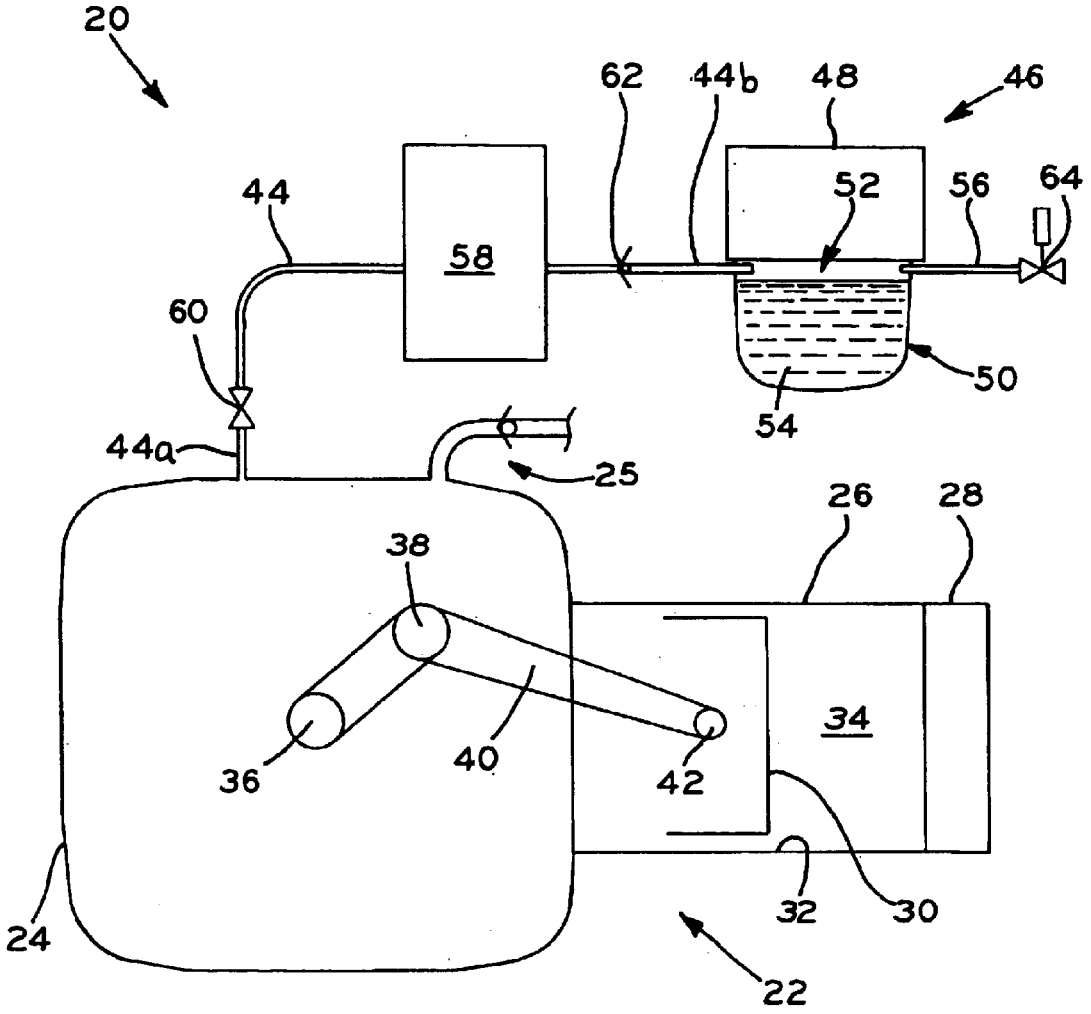
FIG. 1 is a schematic representation of an exemplary automatic priming system according to the present invention.

Referring to FIG. 1, automatic priming system 20 is schematically shown in connection with engine 22, and is shown in greater detail according to alternate embodiments in FIGS. 2–5. Engine 22 may be a small, single or twin cylinder internal combustion engine of the type used in lawn mowers, lawn and garden tractors, snow throwers, generators, other working implements, or in small sport vehicles. Further, engine 22 may have a valve train of an overhead cam ("OHC"), overhead valve ("OHV"), or side valve/L-head type.

Figure 2:
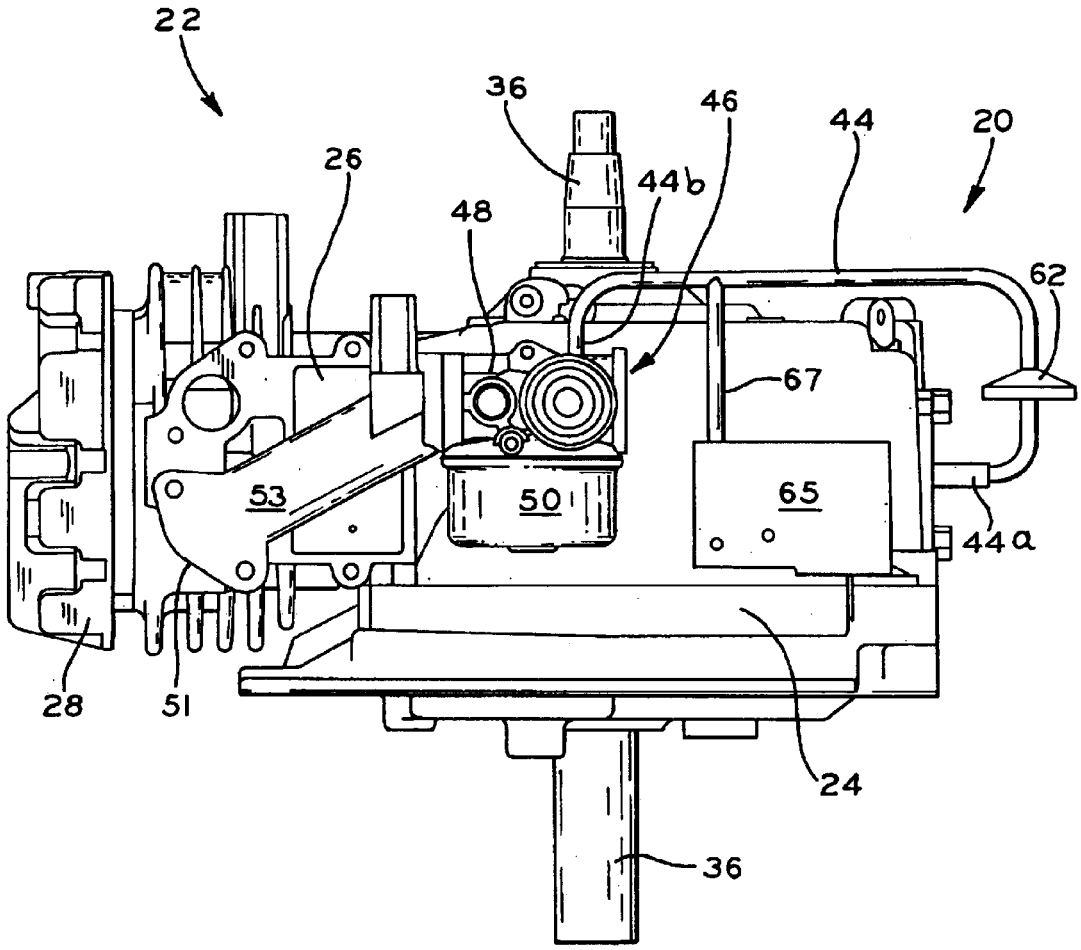
FIG. 2 is a first side view of an internal combustion engine including an automatic priming system according to an alternative embodiment.
Figure 3:
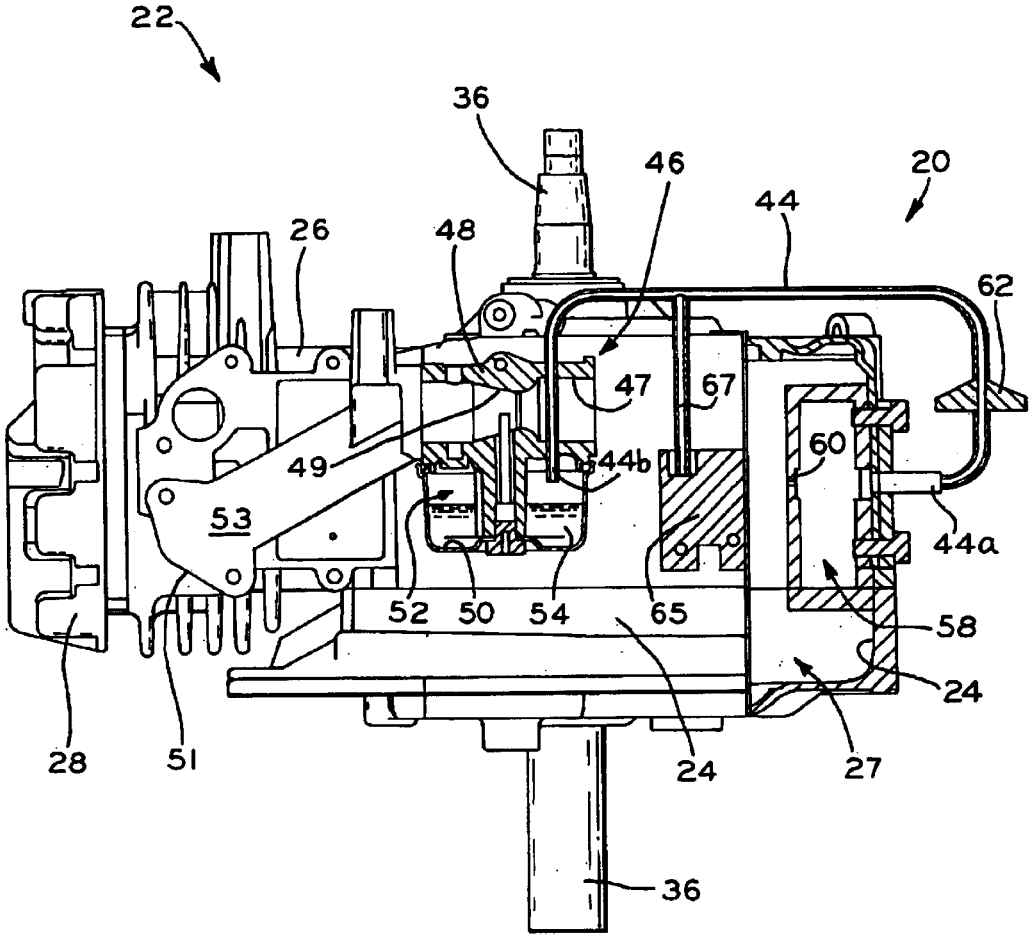
FIG. 3 is a second side view of the engine of FIG. 2, showing the carburetor and a portion of the crankcase in section.
Figure 4:
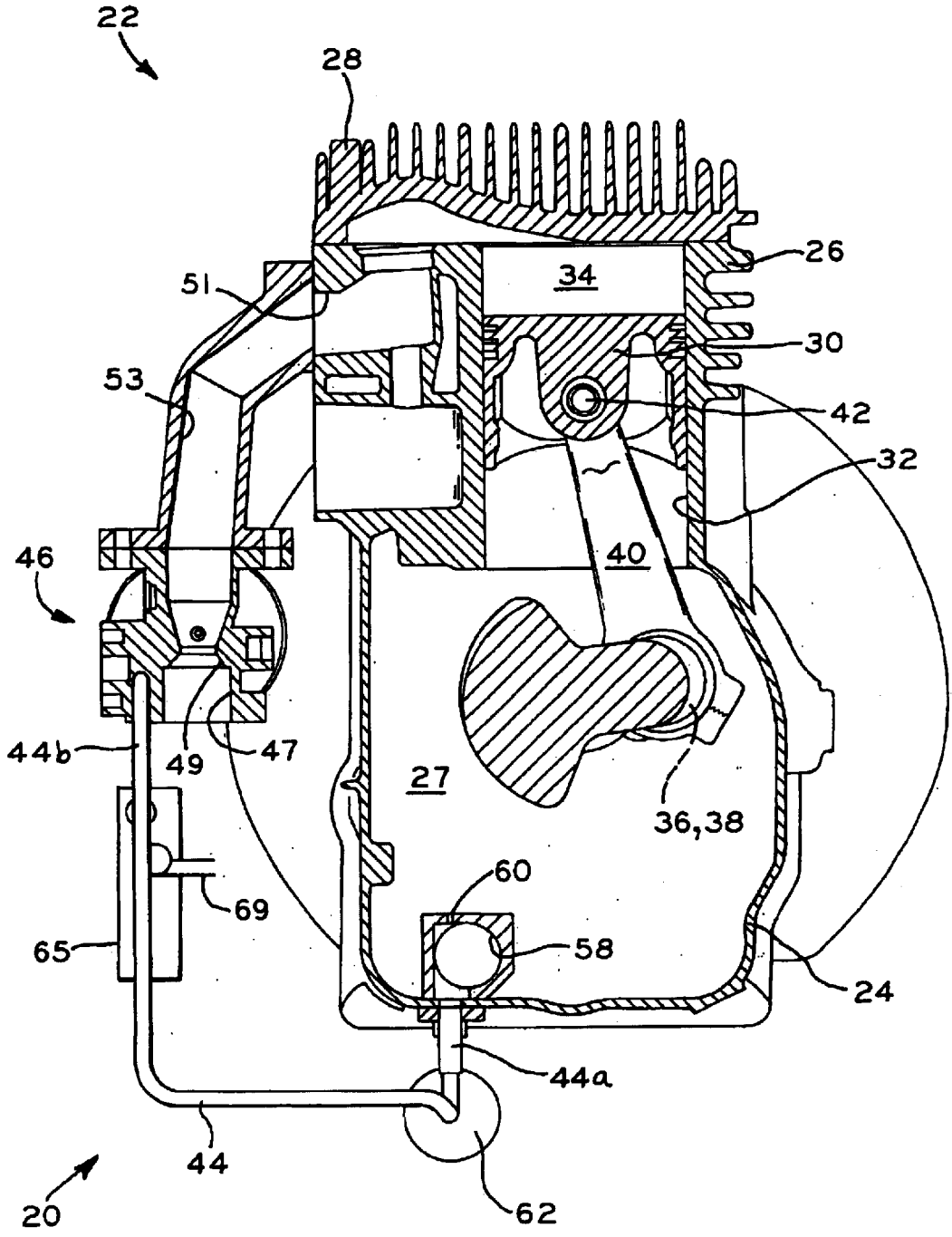
FIG. 4 is a top view of the engine of FIGS. 2 and 3, showing the crankcase, cylinder block, and carburetor in section.

Engine 22 includes crankcase 24, cylinder block 26 attached to crankcase 24, and cylinder head 28 attached to cylinder block 26. Optionally, as shown in FIG. 4, crankcase 24 and cylinder block 26 may be integrally formed with one another, or cylinder block 26 and cylinder head 28 may be integrally formed with one another. Piston 30 is slidably received within cylinder 32 in cylinder block 26, and combustion chamber 34 is defined between piston 30 and cylinder head 28. Crankshaft 36 is rotatably supported within crankcase 24 via suitable bearings (not shown), and includes eccentric crank pin 38 to which one end of connecting rod 40 is coupled, with the opposite end of connecting rod 40 coupled to wrist pin 42 of piston 30. Crankshaft 36 may be vertically disposed as shown in FIGS. 2 and 3 or alternatively, may be horizontally disposed. The crankshaft 36, connecting rod 40, and piston 30 assembly may be manually cranked by an operator for starting engine 22 using a recoil motor, for example.

At engine cranking speeds and at engine running speeds, reciprocation of piston 30 within cylinder 32 creates pressure fluctuations, or pulses, within crankcase 24. Specifically, as piston 30 approaches its top dead center ("TDC") position, a negative, or less than atmospheric, pressure is created within crankcase 24 and, as piston 30 retreats from its TDC position toward its bottom dead center ("BDC") position, a positive, or greater than atmospheric, pressure is created within crankcase 24.

Additionally, during combustion of air/fuel mixture within combustion chamber 34 of engine 22, a portion of the gases within combustion chamber 32 may pass between piston 30 and cylinder 32 and enter crankcase 24. These gases are typically referred to as "blow-by" gases, and would normally tend to build up within crankcase 24 to create an average positive pressure within crankcase 24. However, the blow-by gases are typically vented out of crankcase 24 through a one-way breather valve 25 (FIG. 1) connected to crankcase 24. The blow-by gases, upon venting from crankcase 24, may be directed to the intake system of engine 22 for recycling. During the period immediately after venting of blow-by gases through breather valve 25, movement of piston 30 toward its TDC position creates a negative pressure, or partial vacuum condition, within crankcase 24.

In this manner, because breather valve 25 only allows gasses to exit crankcase 24, the average pressure within crankcase 24 is below atmospheric pressure while engine 22 is running, with pressure fluctuations within crankcase 24 occurring in a generally sinusoidal manner as piston 30 reciprocates between its TDC and BDC positions. Although the average of the sinusoidal pressure fluctuations within crankcase 24 is negative, or below atmospheric, the periodic extremes of the pressure pulses, which occur around the BDC position of piston 30, are positive, i.e., are above atmospheric pressure. As discussed below, these positive pressure pulses are used in automatic priming system 20 for priming.

As shown in FIG. 1 and also in FIGS. 2–5, automatic priming system 20 generally includes conduit 44 connected to crankcase 24 at its first end 44*a*, and connected to carburetor 46 at its opposite end 44*b*. Carburetor 46 includes main body portion 48, in which a carburetor throat 47 (FIGS. 3–5), venturi 49 (FIGS. 3–5), and throttle valve (not shown) are disposed, and also includes fuel bowl 50 disposed beneath main body portion 48. Carburetor 46 may be of the type disclosed in U.S. Pat. No. 6,152,431, assigned to the assignee of the present invention, the disclosure of which is expressly incorporated herein by reference. Main body portion 48 of carburetor 46 is operably connected to intake port 51 or engine 22 via intake manifold 53, as shown in FIG. 4 for example, to supply an air/fuel mixture for combustion within combustion chamber 34 of engine 22.

Figure 5:
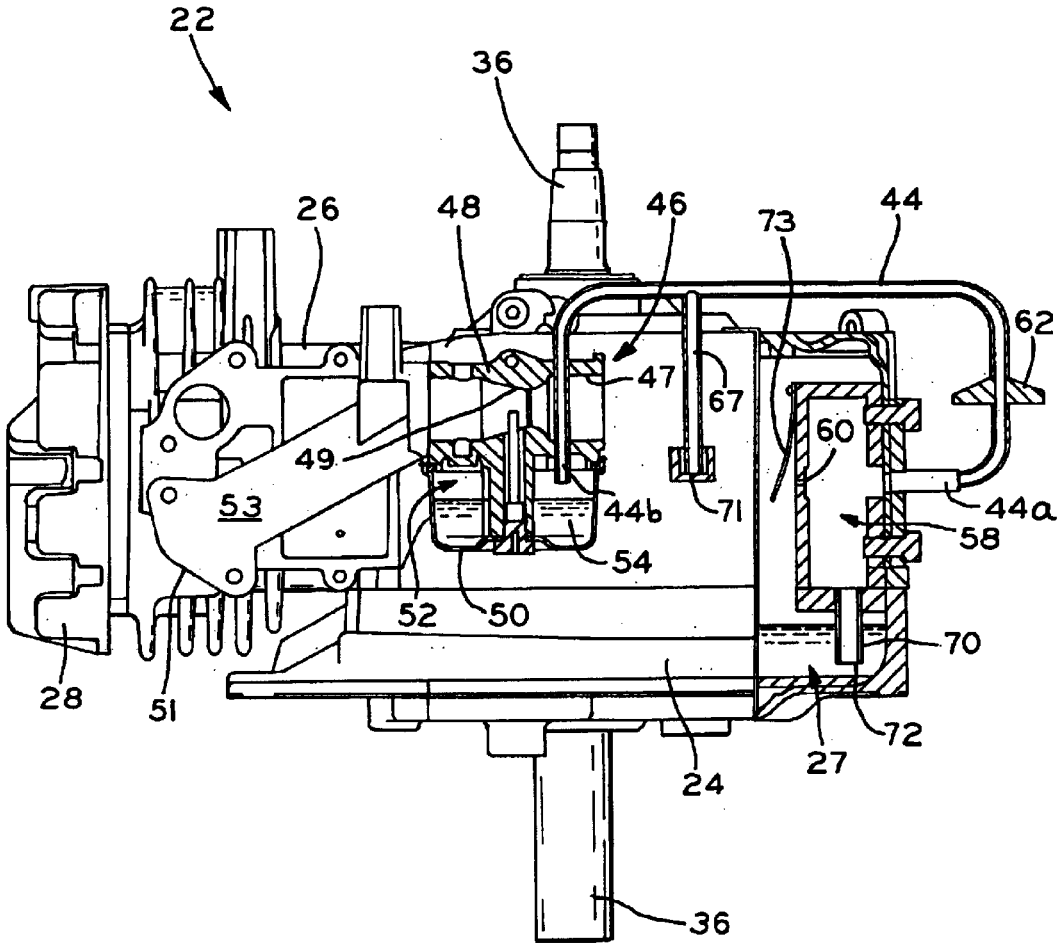
FIG. 5 is a side view of an internal combustion engine including an automatic priming system according to a further alternative embodiment, showing the carburetor and a portion of the crankcase in section, the engine further including a low oil shutdown feature.

As shown in FIG. 1 and also in FIGS. 3 and 5, end 44*b* of conduit 44 is connected to carburetor 46 in communication with fuel bowl 50, and specifically, with air space 52 above a quantity of fuel 54 which is contained within fuel bowl 50. A float valve (not shown) within fuel bowl 50 meters fuel into fuel bowl 50 from a main fuel tank (not shown) of engine 22. The present invention is described herein with respect to a carburetor of the type including a fuel bowl in which priming is carried out by pressurizing an air space above a quantity of fuel in the fuel bowl to thereby force fuel from the fuel bowl into the throat of the carburetor. However, the present invention is more generally applicable for use with other types of carburetors or with separate, designated priming devices which may operate by being pressurized.

As shown in FIG. 1, carburetor 46 may additionally include vent conduit 56. In an externally vented carburetor, vent conduit 56 fluidly communicates fuel bowl 50 to the atmosphere. Alternatively, in an internally vented carburetor, vent conduit 56 fluidly communicates fuel bowl 50 to the air inlet side of carburetor 46. Vent conduit 56 may include a vent valve 64, such as a solenoid valve, for example, which is operable in a suitable manner to close during engine starting and to open during engine running, as described further below. For example, vent valve 64 may be controlled by the ignition system of engine 22, or may comprise a thermostatic or bimetallic element responsive to heat produced by engine 22 after engine 22 starts. In FIGS. 2–4, vent valve 64 is alternatively shown as a solenoid valve 65 in fluid communication with conduit 44 via branch conduit 67, and includes vent port 69.

Conduit 44 further includes a dampening or accumulator chamber 58, shown in FIG. 1 between crankcase 24 and carburetor 46 which, in the exemplary embodiment of FIGS. 6–10, has a volume of approximately 20 cc (20 $cm^3$). Conduit 44 additionally includes restrictor 60, shown in FIG. 1 between crankcase 24 and chamber 58 which, in the exemplary embodiment of FIGS. 6–10, has a diameter of 0.065 inches. However, the size of restrictor 60 may vary depending upon the particular characteristics of each engine, such as crankcase compression ratio and the volume of chamber 58, as discussed below. Restrictor 60 may be a small opening between crankcase 24 and chamber 58, or a throttling orifice, for example, having a diameter which is smaller than that of conduit 44, or may be any other suitable device which is operable to restrict fluid movement between crankcase 24 and chamber 58, as described below. A one-way check valve 62 is shown in FIG. 1 disposed in conduit 44 between chamber 58 and carburetor 46. Check valve 62 is configured to permit the fluid flow from chamber 58 to carburetor 46, and to block fluid flow from carburetor 46 to chamber 58.

Although chamber 58, restrictor 60, and check valve 62 have been shown in FIG. 1 as being associated with a common conduit 44, conduit 44 may be eliminated altogether by, for example, integrating one or more of the foregoing components into a single structural unit which is attached to crankcase 24, or alternatively, each of the foregoing components may be integrated into crankcase 24 itself. For example, as shown in FIGS. 2–5, the arrangement of the components of priming system 20 is modified as follows. Chamber 58 is disposed within crankcase 24, and includes restrictor 60 in a wall thereof, such that chamber 58 and crankcase 24 are in communication through restrictor 60. Further, check valve 62 is shown in conduit 44 between crankcase 24 and carburetor 46 externally of crankcase 24. In this manner, the components of priming system 20 may be selectively arranged as desired, while preserving the overall operational characteristics of priming system 20, the operation of which is described below.

Figure 6:
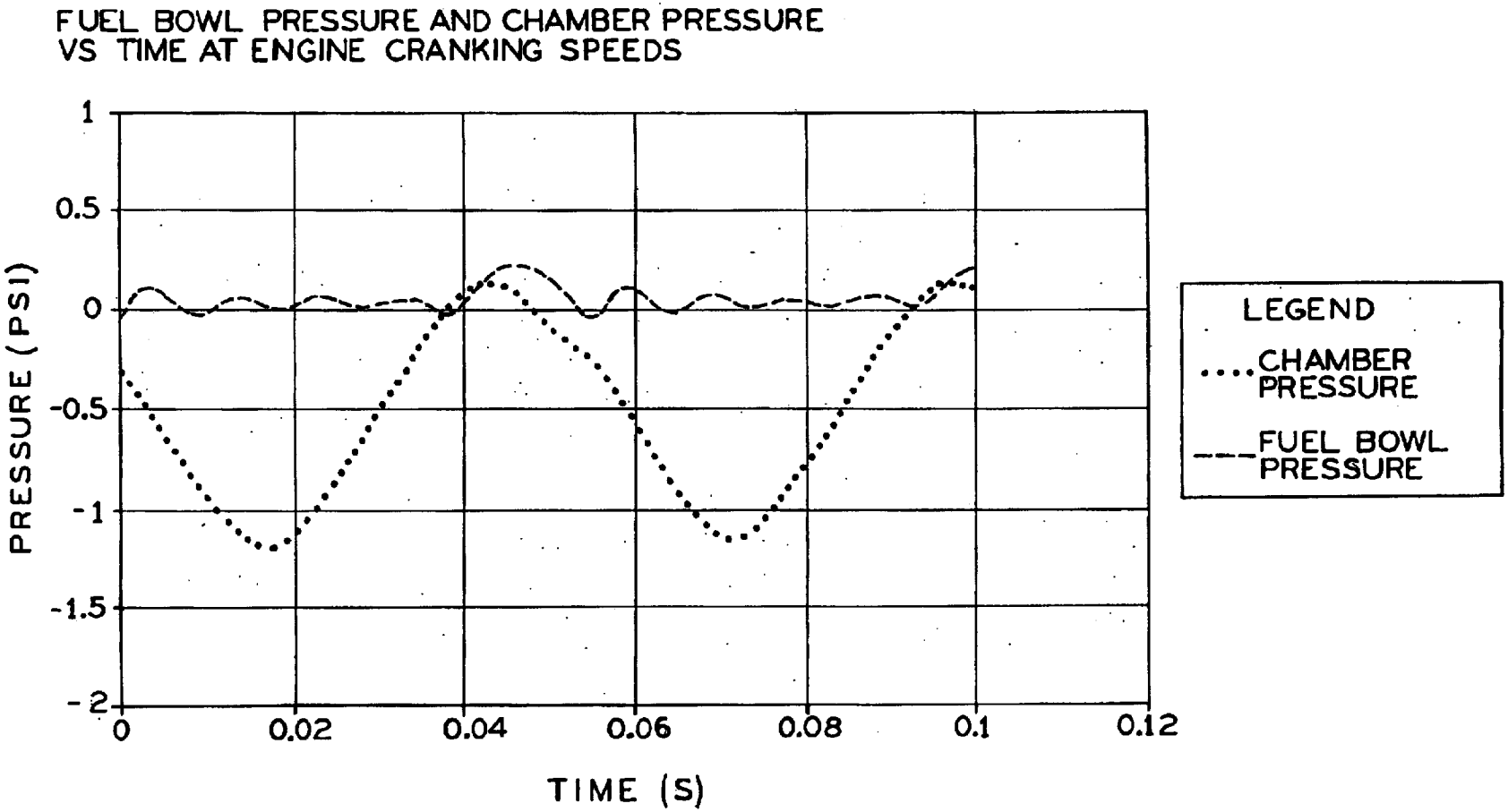
FIG. 6 is a graphic representation of fuel bowl pressure and chamber pressure vs. time at engine cranking speeds.
Figure 7:
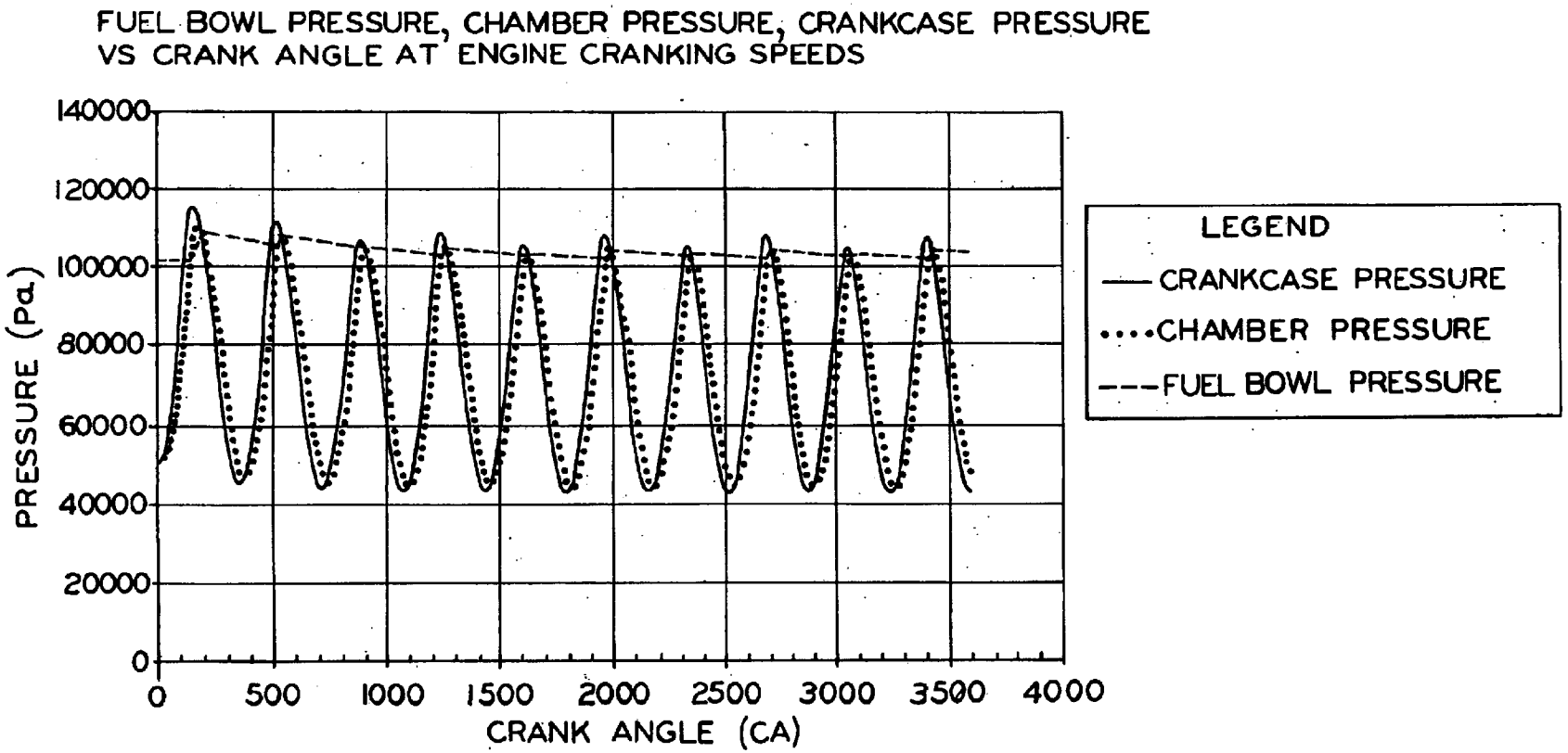
FIG. 7 is a graphic representation of crankcase pressure, chamber pressure, and fuel bowl pressure vs. crank angle at engine cranking speeds.
Figure 8:
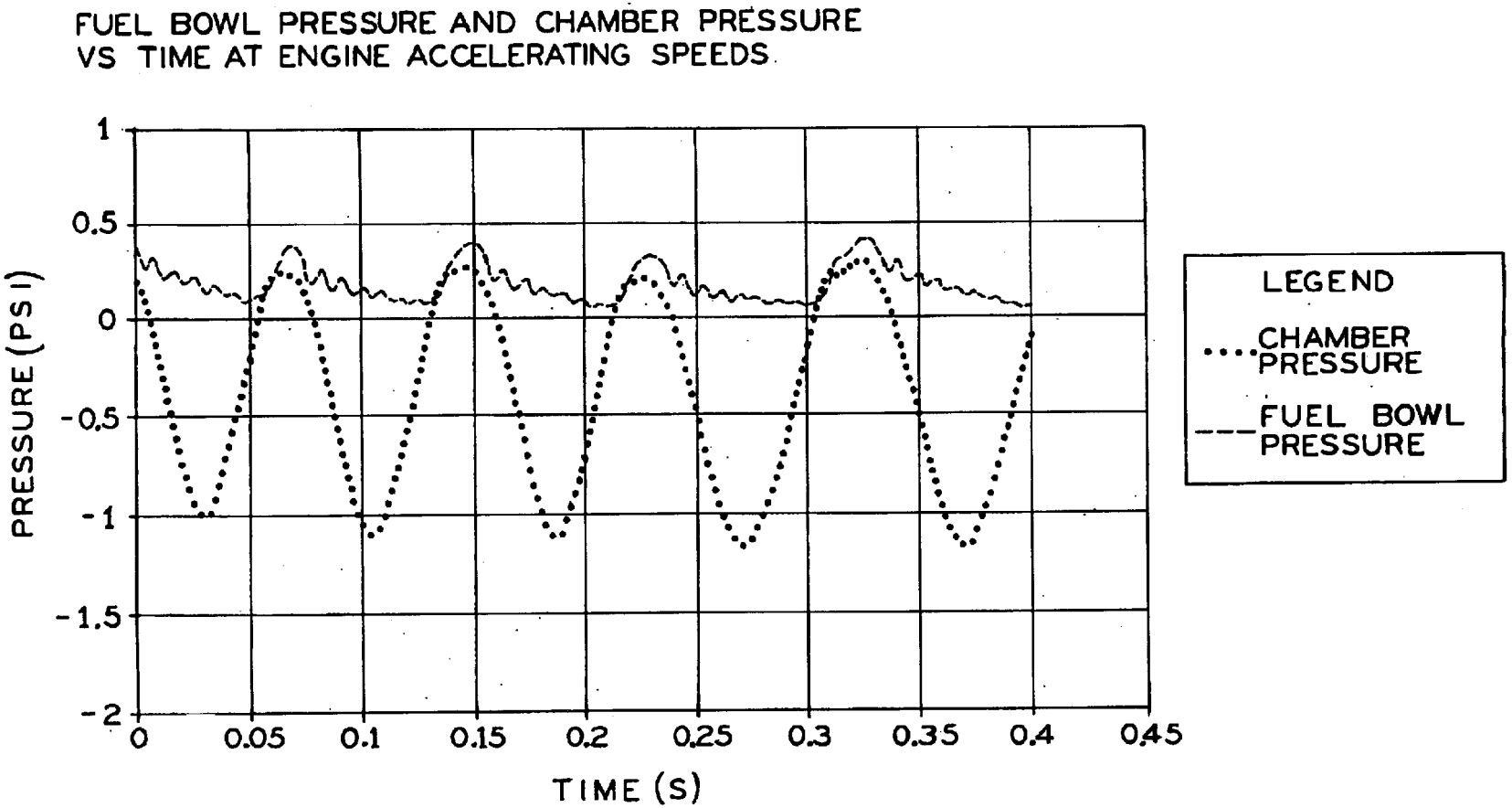
FIG. 8 is a graphic representation of fuel bowl pressure and chamber pressure vs. time at engine accelerating speeds immediately after engine starting.
Figure 9:
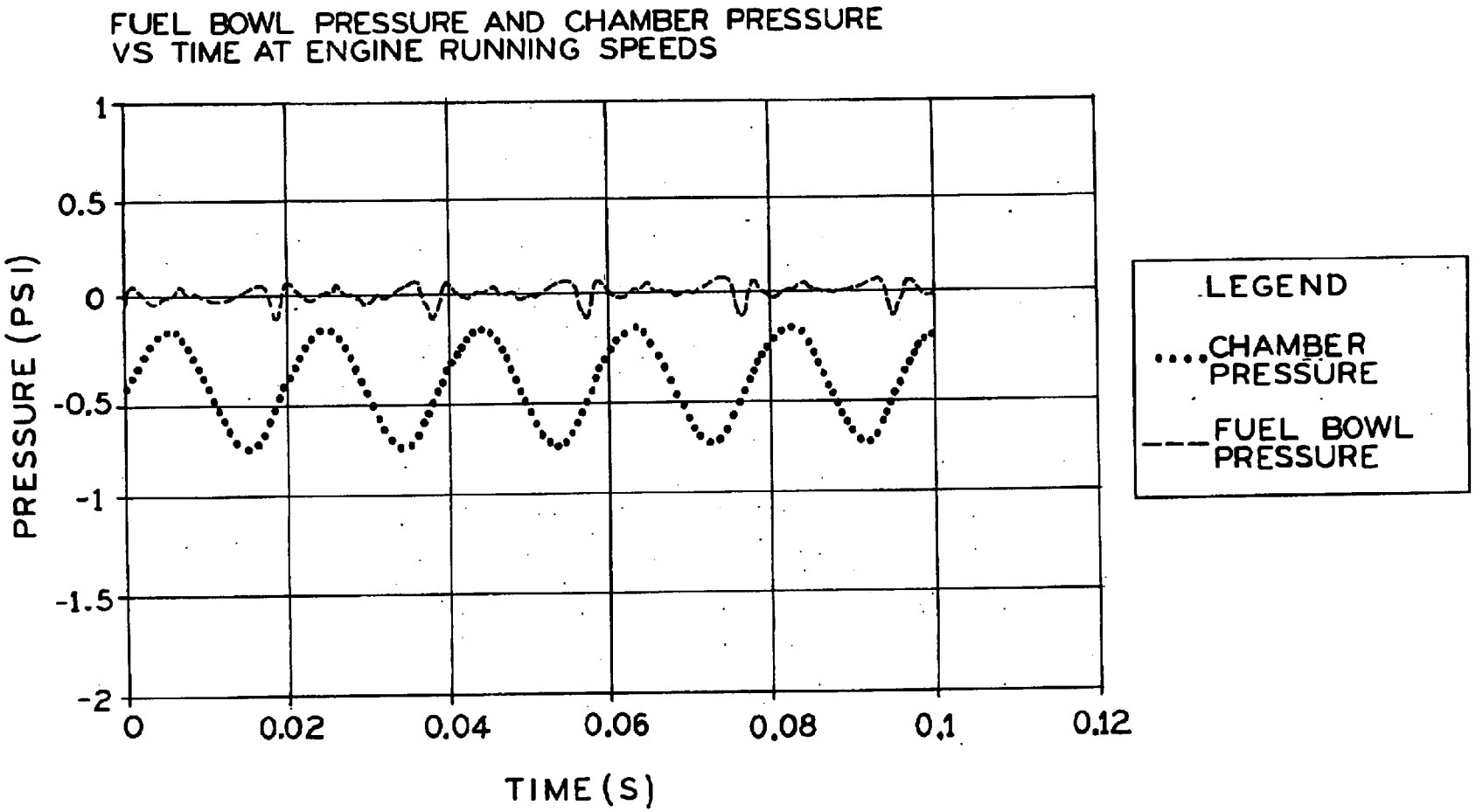
FIG. 9 is a graphic representation of fuel bowl pressure and chamber pressure vs. time at engine running speeds.
Figure 10:
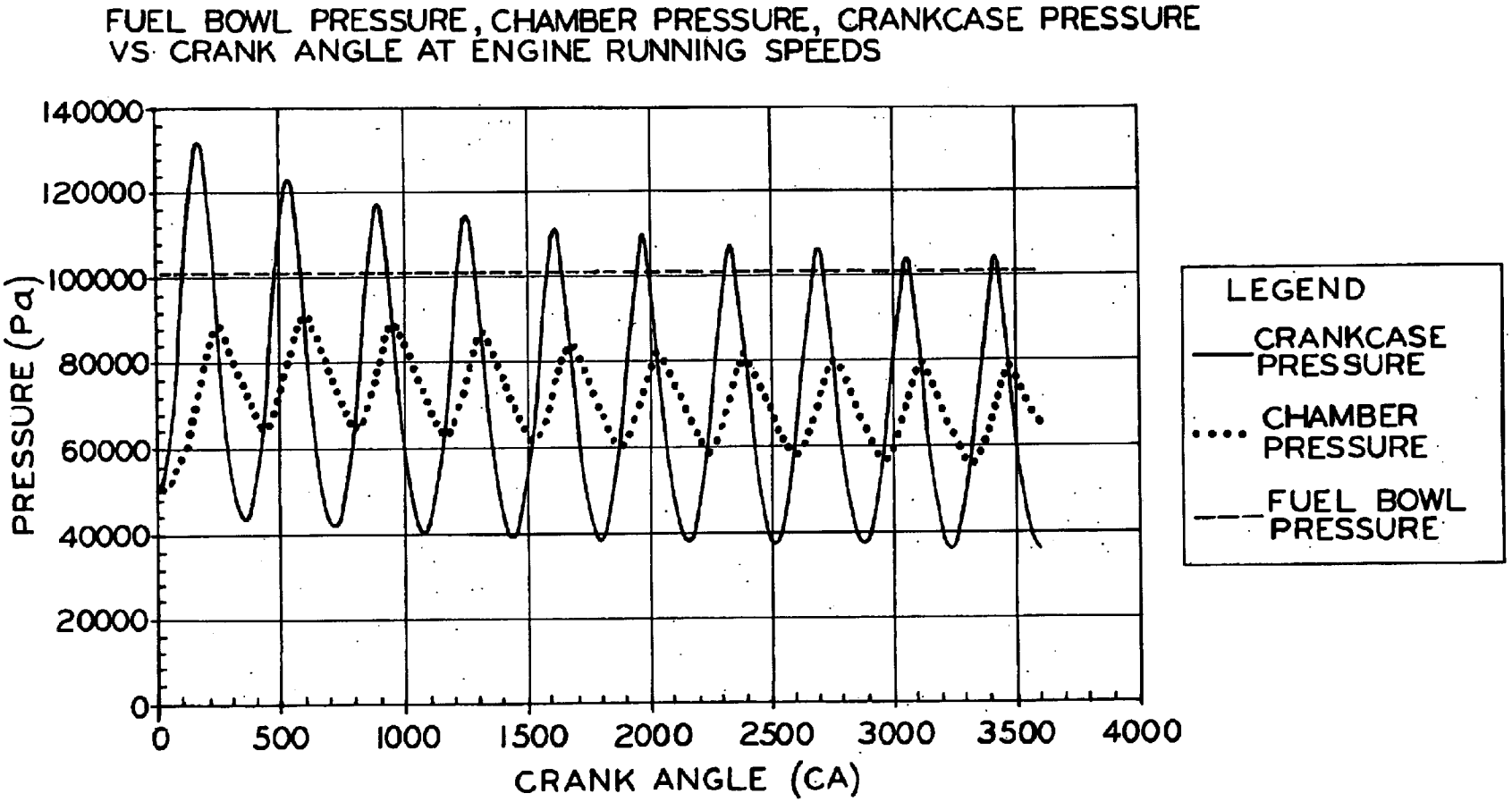
FIG. 10 is a graphic representation of crankcase pressure, chamber pressure, and fuel bowl pressure vs. crank angle at engine running speeds.

With reference to FIGS. 1–5 and further to FIGS. 6–10, operation of automatic priming system 20 will now be described. FIGS. 6, 8, and 9 each show pressure curves for chamber 58 and fuel bowl 50 in pounds per square inch ("PSI") vs. time in seconds. FIGS. 7 and 10 each show pressure curves for crankcase 24, chamber 58 and fuel bowl 50 in absolute pressure (Pascals, "Pa") vs. crank angle, whereby 101,000 Pa corresponds to atmospheric pressure.

When starting engine 22, vent valve 64 (FIG. 1) or solenoid valve 65 (FIGS. 2–4) is closed. Advantageously, closing of vent valve 64 (FIG. 1) or solenoid valve 65 (FIGS. 2–4) prevents communication of fuel bowl 50 of carburetor 46 with the atmosphere, such that emission of fuel vapors from fuel bowl 50 into the atmosphere is prevented. At low engine speeds during engine cranking (starting), which are typically between about 100 and about 800 rpm in most small engines, piston 30 reciprocates relatively slowly, and the positive and negative pressure pulses within crankcase 24 which are created by the reciprocation of piston 30 are communicated between crankcase 24 and chamber 58 through restrictor 60. Thus, restrictor 60 does not restrict or inhibit fluid flow between crankcase 24 and chamber 58 at are substantially equalized. Positive pressure pulses within crankcase 24 and chamber 58, which are above atmospheric pressure, pass through check valve 62 into carburetor 46, and into air space 52 above fuel 54 within fuel bowl 50. In this manner, because vent valve 64 of fuel bowl 50 is closed, air space 52 is pressurized and a quantity of fuel 54 is forced into the carburetor throat within main body portion 48 of carburetor 46 for engine priming.

Referring to FIG. 6, the relationship between the pressures within chamber 58 and fuel bowl 50 of carburetor 46 is shown at cranking speeds of engine 22. Further, referring to FIG. 7, the relationships between the pressures within crankcase 24, chamber 58, and fuel bowl 50 are shown at engine cranking speeds. As may be seen from FIG. 7, positive and negative pressure fluctuations of the pressures within crankcase 24 and within chamber 58 occur in a sinusoidal manner, with the pressure fluctuations within chamber 58 closely following the pressure fluctuations within crankcase 24 due to the fluid communication between crankcase 24 and chamber 58 through restrictor 60. Further, the extremes of these pressure fluctuations rise above atmospheric pressure to generate positive pressure pulses. The positive pressure pulses are communicated from chamber 58 through check valve 62 and into fuel bowl 50 as described above. As may be seen from FIGS. 6 and 7, the pressure within fuel bowl 50 increases responsive to the passing of each positive pressure pulse into fuel bowl 50 from chamber 58, thus, positive pressure pulses in chamber 58 cause corresponding rises in the pressure 68 within fuel bowl 50. The rises in pressure within fuel bowl 50 pressurize air space 52 of fuel bowl 50 for priming, as described above.

After engine 22 starts, the speed of engine 22 rapidly increases during an acceleration period through a range of from about 800 rpm to about 1600 rpm for most small engines. At these speeds, the positive and negative pressure fluctuations within crankcase 24 caused by reciprocation of piston 30 are still adequately communicated through restrictor 60 to chamber 58, to the extent that the pressures within crankcase 24 and within chamber 58 remain substantially equalized. In this manner, referring to FIG. 8, positive pressure pulses still exist within chamber 58, which pass through check valve 62 into fuel bowl 50 of carburetor 40, resulting in corresponding rises in the pressure within fuel bowl 50 to continue the above-described priming function. Thus, during the acceleration period of engine 22 before engine 22 reaches full running speeds, an enriched air/fuel mixture is supplied to engine 22 by carburetor 46. Also, after engine 22 starts, vent valve 64 (FIG. 1) or solenoid valve 65 (FIGS. 2–4) may be opened at a desired time or engine temperature to allow venting Alternatively, as shown in FIG. 5, conduit 44 may include a second check valve 71 therein, which allows air from the atmosphere to enter fuel bowl 50 of carburetor 50 for venting fuel bowl to the atmosphere during running of engine 22, yet prevents air and/or fuel vapors from exiting the intake system of engine 22 to the atmosphere. Although check valve 71 is shown within conduit 44 in FIG. 5, the location of check valve 71 may vary. For example, check valve 71 may be disposed within carburetor 46.

When engine 22 reaches its running speed, which is typically between about 1600 rpm and about 4000 rpm for most small engines, the very rapid reciprocation of piston 30 creates very rapid fluctuations of pressure within crankcase 24. At engine running speeds, such pressure fluctuations occur at such frequency that they cannot be fully communicated through restrictor 60 to chamber 58. In other words, restrictor 60 functions to restrict or dampen the full communication of the pressure pulses within crankcase 24 to chamber 58 at engine running speeds. As discussed above and shown in FIG. 10, the average pressure within crankcase 24 at running speeds of engine 22 is below atmospheric pressure, yet periodically exceeds atmospheric pressure at the extremes of the positive pressure fluctuations. However, at engine running speeds, as shown in FIGS. 9 and 10, the pressure fluctuations within crankcase 24 are much more pronounced than the corresponding pressure fluctuations within chamber 58, due to the dampening effect of restrictor 60. As may be seen in FIGS. 9 and 10, no positive pressure pulses exist within chamber 58 at engine running speeds which could pass through check valve 62 and into fuel bowl 50 of carburetor 46. Therefore, at engine running speeds, the pressure 68 within fuel bowl 50 remains at substantially atmospheric, as shown in FIGS. 9 and 10, and the priming function is automatically disabled.

As is apparent from the above description, automatic priming system 20 is driven by the pressure fluctuations within crankcase 24 which are caused by the reciprocation of piston 30, wherein such pressure fluctuations are automatically controlled by restrictor 60, chamber 58, and check valve 62 to prime carburetor 46 at low engine speeds and to disable the priming function at engine running speeds. Therefore, automatic priming system 20 advantageously does not require manual priming of carburetor 46 or manual operation of a choke feature of carburetor 46 by an operator in order to prime carburetor 46 for engine starting, and to disable the priming function when engine 22 reaches running speed.

Further, if engine 22 reaches running speeds too quickly after starting, and without an adequate acceleration period, the priming system is automatically deactivated as described above. However, the speed of engine 22 will decrease, and re-activate the priming system to supply engine 22 with an enriched air/fuel mixture until engine 22 regains a proper running speed and the priming system is again automatically deactivated.

The volume of chamber 58 and the size of restrictor 60 may be specifically varied or tuned to provide for disabling of the priming feature at a specific, predetermined engine speed. Additionally, the sizes of chamber 58 and restrictor 60 may be specifically varied or tuned as necessary depending upon the size of the engine or the running speed of the engine.

Further, referring to FIGS. 2–4, solenoid valve 65 may be controlled to disable the above-described priming function at specified engine temperature, regardless of engine speed. For example, solenoid valve 65 may be controlled by a thermally-sensitive element, such as a bimetallic element, thermostat, or thermocouple for example, which senses engine temperature. At cold engine temperatures, such as during cold starts of engine 22, solenoid valve 65 is closed, and automatic priming of engine 22 may function as described above. At higher engine temperatures, solenoid valve 65 opens to vent or bleed off conduit 44 through vent port 69, thereby disabling the priming function. Advantageously, in this manner, the above-described priming function is disabled during warm re-starts of engine 22.

Alternatively, as shown in FIG. 5, chamber 58 may include bimetallic valve element 73, shown in FIG. 5 in the form of a strip of bimetallic material attached to the wall of chamber 58 near restrictor 60. When engine 22 is cold, valve element 73 is disposed as shown in FIG. 5, such that valve element 73 is spaced away from restrictor 60 and does not cover restrictor 60. Thus, fluid communication between crankcase 24 and chamber 58 is allowed, and the present priming system functions as described above. However, after engine 22 starts and temperatures within crankcase 24 increase, valve element 73 deforms, and moves to a position in which valve element 73 covers restrictor 60 and prevents fluid communication between crankcase 24 and chamber 58 through restrictor 60. In this manner, the operation present priming system is positively disabled when engine 22 reaches a warm temperature.

An analytical model of the present automatic priming system is described below, in which the following nomenclature is used:

| | |
|---|---|
| a | Speed of sound, meters/second |
| $A_{res}$ | Area of restrictor, square meters |
| $C_d$ | Discharge coefficient |
| $C_v$ | Constant volume specific heat, Joules/(Kg*K) |
| h | Specific enthalpy, Joules/Kg |
| k | Specific heat ratio |
| m | Mass, Kg |
| $P_0$ | Upstream stagnation pressure |
| $P_1/P_0$ | Pressure ratio |
| R | Gas constant, Joules/(Kg*K) |
| R | Ratio of connecting rod length to crank radius in Equation (1.1) |
| $r_c$ | Compression ratio |
| t | Time, seconds |
| T | Temperature, Kelvin |
| u | Specific internal energy, Joules/Kg |
| $U_s$ | Sensible energy, Joules |
| V | Volume, cubic meters |
| $V_d$ | Displaced or swept volume, cubic meters |
| W | Work by piston, Joules |
| θ | Crank angle, radians |
| cyl | cylinder |
| cc | crankcase |
| acc | accumulator |
| carb | carburetor float bowl |
| breather | crankcase breather |
| blowby | gas flow past the piston into the crankcase |

In the analytical model below, the pressure fluctuations in crankcase 24, chamber 58, and fuel bowl 50 are described. The volume of the crankcase 24, $V_{cc}$, changes as piston 30 reciprocates within cylinder 32. The volume of the cylinder 32, $V_{cyl}$, at any crank position θ of crankshaft 36 is:

$$\frac{V_{cyl}}{V_d} = \frac{1}{(r_c - 1)} + \frac{1}{2}\left[R + 1 - \cos\theta - (R^2 - \sin^2\theta)^{\frac{1}{2}}\right] \tag{1.1}$$

The volume of crankcase 24 is related to the volume of cylinder 32 as follows:

$$V_{cc} = V_{cc,max} - V_{cyl} \tag{1.2}$$

The derivation of the basic equation for the pressure of crankcase 24 is based on the first law of thermodynamics and the conservation of mass. To simplify the model, heat transfer through the walls of crankcase 24 and chemistry effects are neglected. The remaining terms in the first law of thermodynamics for this transient control volume system are:

$$0 = \frac{dU_s}{dt} + \frac{dW}{dt} + \frac{d\sum h_i dm_i}{dt} \tag{2.1}$$

The piston work term, $$\frac{dW}{dt},$$

is equal to $$P_{cc}\frac{dV_{cc}}{dt},$$

the product of crankcase pressure and the derivative of crankcase volume with respect to time. Equations (1.1) and (1.2) can be manipulated to obtain $$\frac{dV_{cc}}{dt},$$

the change in the volume of crankcase 24 as a function of time. The rate of change of sensible energy, $$\frac{dU_s}{dt},$$

is given by $$\frac{dU_s}{dt} = m_{cc}C_v\frac{dT_{cc}}{dt} + u_{cc}\frac{dm_{cc}}{dt} \tag{2.2}$$

Introducing an ideal gas assumption, substituting equation (2.2) into (2.1) and then rearranging, an expression for the rate of change of the pressure of crankcase 24 is obtained as shown below.

$$\frac{dP_{cc}}{dt} = \frac{1}{V_{cc}}\left(-a_{cc}^2\frac{dm_{chamb}}{dt} - a_{cc}^2\frac{dm_{breather}}{dt} + a_{cyl}^2\frac{dm_{blow\text{-}by}}{dt} - kP_{cc}\frac{dV_{cc}}{dt}\right) \tag{2.3}$$

Equation (2.3) describes the pressure curve for crankcase 24, which is shown in FIGS. 7 and 10. Where the mass from blow-by gasses increases the total mass in crankcase 24 due to leakage past piston 30, the mass out of breather valve 25 decreases the mass in crankcase 24 when the crankcase pressure is above atmospheric, and the mass to chamber 58 is what is ultimately communicated to carburetor 46 as the priming pressure. Similar expressions are also set forth below for the rate of change of pressures in chamber 58 and in fuel bowl 50 of carburetor 46. However, because chamber 58 and fuel bowl 50 are assumed to have constant volumes, the rates of change of their pressures can be expressed as:

$$\frac{dP_{cham}}{dt} = \frac{1}{V_{cham}}\left(a_{cc}^2\frac{dm_{cham}}{dt} - a_{\exp}^2\frac{dm_{carb}}{dt}\right) \tag{2.4}$$

$$\frac{dP_{carb}}{dt} = \frac{1}{V_{carb}}\left(a_{\exp}^2\frac{dm_{chamb}}{dt} - a_{carb}^2\frac{dm_{carb,out}}{dt}\right) \tag{2.5}$$

Equation (2.4) describes the pressure curve for chamber 58 shown in FIGS. 6–10, and Equation (2.5) describes the pressure curve for fuel bowl 50 shown in FIGS. 6–10. The mass out of carburetor 46 represents the leakage of priming pressure. Equations (2.3) to (2.5) relate the rate of change of pressures to the mass flow rates. Since the mass flow rates are also dependent on the pressure ratios across the volumes, the above equations must be solved iteratively with the mass flow equations. The one-dimensional isentropic mass flow relation used is shown below:

$$\frac{dm}{dt} = \frac{C_d A_{res} P_0}{\sqrt{RT_0}}\left(\frac{P_1}{P_0}\right)^{\frac{1}{k}}\left\{\frac{2k}{k-1}\left[1 - \left(\frac{P_1}{P_0}\right)^{\frac{(k-1)}{k}}\right]\right\}^{\frac{1}{2}} \tag{2.6}$$

The Eulerian first-order integration formula with a small crank angle increment is applied to the set of Equations (2.3) to (2.6). Equation (2.6) generally expresses the mass exchange between two volumes, such as between crankcase 24 and chamber 58, as a function of the opening ($A_{res}$) between the two volumes, such as the size of restrictor 60. In view of the fact that different types of small internal combustion engines have different characteristics, such as crankcase and cylinder volumes, displaced piston swept volume, etc., the above analytical model may be used by one of ordinary skill to design an automatic priming system in accordance with the present invention for any particular small engine. In particular, one of ordinary skill may use the foregoing analytical model according to an iterative process to determine the mass pressure flow which is supplied to the carburetor when different volumes for chamber 58 and sizes for restrictor 60 are used.

Referring to FIG. 5, the present automatic priming system may also include a low oil shutdown feature for engine 22. In FIG. 5, crankcase 24 includes oil sump 27 containing a quantity of lubricating oil therein. During running of engine 22, oil within oil sump 27 may be agitated by an oil dipper (not shown) on crankshaft 36, or by other suitable means, to generate an oil mist for lubricating the moving parts within crankcase 24 and/or other moving parts of engine 22. Alternatively, an oil pump (not shown) may be driven from crankshaft 36 to provide oil under pressure through oil galleries, for example, to various lubrication points within engine 22.

Chamber 58 includes an auxiliary opening, shown herein as conduit 70 extending into oil sump 27, the open lower end 72 of conduit 70 normally disposed below the level of oil in oil sump 27 when oil sump 27 contains a sufficient quantity of oil. In this manner, during running of engine 22, the oil level within oil sump 27 prevents communication of pressure pulses between crankcase 24 and chamber 58 through conduit 70. Thus, communication of pressure pulses between crankcase 24 and chamber 58 is normally only permitted through restrictor 60, and the enabling and disabling of the priming system of engine 22 functions as described above.

However, if the oil level in oil sump 27 drops to a level near or below the open end of conduit 70, such as if engine 22 runs low of oil during running, communication of pressure pulses between crankcase 24 and chamber 58 through conduit 70 will be allowed. Conduit 70 has a diameter much larger that that of restrictor 60, such that when communication of pressure pulses between crankcase 24 and chamber 58 is established, positive and negative pressure pulses will move freely and substantially uninhibited between crankcase 24 and chamber 58. Positive pressure pulses within chamber 58 will then pass to fuel bowl 50 of carburetor 46, thereby pressurizing fuel bowl 50 and providing excess fuel to throat 47 of carburetor 46, supplying an overly rich air/fuel mixture to engine 22 such that engine 22 will stall. In this manner, a low oil shutdown feature is provided, which disables running of engine 22 when the amount of oil within oil sump 27 of crankcase 24 falls below a level in which damage to engine 22 might potentially occur.

While the present invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An internal combustion engine, comprising:

an engine housing including a crankcase and a cylinder;

a crankshaft, connecting rod, and piston assembly disposed within said engine housing, said piston reciprocable within said cylinder to generate positive and negative pressure pulses within said crankcase during cranking and running speeds of said engine;

a carburetor attached to said engine housing; and a priming system, comprising:

a chamber in fluid communication with said crankcase through a restrictor, said chamber also in fluid communication with said carburetor through a one-way valve permitting fluid flow from said chamber to said carburetor, said restrictor dimensioned to allow substantially uninhibited communication of pressure pulses between said crankcase and said chamber at engine cranking speeds and to dampen communication of pressure pulses between said crankcase and said chamber at engine running speeds;

whereby at engine cranking speeds, positive pressure pulses may pass from said chamber to said carburetor through said one-way valve, and at engine running speeds, said positive pressure pulses are substantially absent within said chamber.

2. The engine of claim 1, wherein said crankcase includes a breather valve permitting escape of fluid from said crankcase and preventing entry of fluid into said crankcase.

3. The engine of claim 1, wherein said carburetor includes a fuel bowl containing a quantity of fuel with an air space above the fuel, said chamber in fluid communication with said air space whereby at engine cranking speeds, said positive pressure pulses pass into said air space and pressurize said air space.

4. The engine of claim 1, wherein said chamber is disposed within said crankcase, said restrictor comprising a restriction orifice between said crankcase and said chamber.

5. The engine of claim 1, wherein said chamber is disposed externally of said crankcase, said restrictor comprising a passageway fluidly communicating said crankcase and said chamber.

6. The engine of claim 1, further comprising a passageway fluidly communicating said chamber and said carburetor, said one-way valve disposed within said passageway.

7. The engine of claim 1, further comprising a carburetor vent allowing air from the atmosphere into said fuel bowl at engine running speeds.

8. The engine of claim 1, wherein said restrictor further comprises a valve element permitting fluid communication between said crankcase and said chamber at engine cranking speeds and blocking fluid communication between said crankcase and said chamber at engine running speeds.

9. The engine of claim 1, wherein said chamber includes an opening disposed below a level of oil within said crankcase, whereby if said oil level falls below said opening at engine running speeds, communication of said pressure pulses between said crankcase and said chamber is substantially uninhibited such that said positive pressure pulses may pass from said chamber to said carburetor through said one-way valve.

10. An internal combustion engine, comprising:

an engine housing including a crankcase and a cylinder;

a crankshaft, connecting rod, and piston assembly disposed within said engine housing, said piston reciprocable within said cylinder to generate positive and negative pressure pulses within said crankcase during cranking and running speeds of said engine;

a carburetor attached to said engine housing; and a priming system, comprising:

a chamber in fluid communication with said crankcase, said chamber also in fluid communication with said carburetor;

a check valve disposed between said chamber and said carburetor, said check valve permitting fluid flow from said chamber to said carburetor and preventing fluid flow from said carburetor to said chamber; and means for allowing substantial pressure equalization between said crankcase and said chamber at engine cranking speeds such that positive pressure pulses may pass from said chamber and through said check valve to said carburetor for priming, and for preventing substantial pressure equalization between said crankcase and said chamber at engine running speeds such that positive pressure pulses are not present within said chamber.

11. The engine of claim 10, wherein said means comprises a restriction orifice between said crankcase and said chamber, said crankcase and said chamber in fluid communication through said restriction orifice.

12. The engine of claim 11, wherein said chamber is disposed within said crankcase, said restriction orifice comprises an opening in a wall of said chamber.

13. The engine of claim 10, wherein said carburetor includes a fuel bowl containing a quantity of fuel with an air space above the fuel, said chamber in fluid communication with said air space whereby said positive pressure pulses pass into said air space at engine cranking speeds and pressurize said air space.

14. The engine of claim 10, further comprising a one-way breather valve in fluid communication with said crankcase and permitting escape of fluid from said crankcase.

15. The engine of claim 10, further comprising means for venting said carburetor during engine running speeds.

16. A method of operating an internal combustion engine, comprising the steps of:

cranking a crankshaft, connecting rod, and piston assembly of the engine to reciprocate the piston within a cylinder and to generate positive and negative pressure pulses within a crankcase of the engine;

allowing substantially uninhibited fluid communication during cranking between the crankcase and a chamber in fluid communication with the crankcase;

during cranking, conducting positive pressure pulses from the chamber to the carburetor for priming while preventing passage of negative pressure pulses from the chamber to the carburetor;

starting the engine; and subsequent to starting the engine, preventing substantially the passage of positive pressure pulses from the chamber to the carburetor by venting the positive pressure pulses at a location between the chamber and the carburetor.

17. The method of claim 16, wherein said preventing step subsequent to starting the engine comprises inhibiting fluid communication between the crankcase and the chamber to substantially eliminate positive pressure pulses in the chamber.

18. The method of claim 16, wherein said conducting step during cranking comprises conducting positive pressure pulses to an air space above fuel in a fuel bowl of the carburetor to pressurize the fuel bowl.

19. The method of claim 16, wherein said allowing step comprises allowing fluid communication between the crankcase and the chamber through a restrictor.

20. An internal combustion engine, comprising:

an engine housing including a crankcase and at least one cylinder;

a crankshaft rotatably disposed within said engine housing;

a connecting rod and piston corresponding to each said cylinder, each said connecting rod connected to said crankshaft and each said piston reciprocable within a respective cylinder to generate positive and negative pressure pulses within said crankcase during cranking and running speeds of said engine;

a carburetor; and a priming system, comprising, in serial order:

a restrictor;

a chamber in fluid communication with said crankcase through said restrictor; and a one-way valve permitting fluid flow from said chamber to said carburetor, said restrictor dimensioned to allow substantially uninhibited communication of pressure pulses between said crankcase and said chamber at engine cranking speeds and to dampen communication of pressure pulses between said crankcase and said chamber at engine running speeds;

whereby at engine cranking speeds, positive pressure pulses may freely pass from said chamber to said carburetor through said one-way valve, and at engine running speeds, communication of said positive pressure pulses from said crankcase to said chamber is dampened.

21. The engine of claim 20, wherein said carburetor includes a fuel bowl containing a quantity of fuel with an air space above the fuel, said chamber in fluid communication with said air space, whereby at engine cranking speeds, said positive pressure pulses pass into said air space and pressurize said air space.

22. The engine of claim 20, wherein said chamber is one of:

disposed within said crankcase, said restrictor comprising a restriction orifice between said crankcase and said chamber; and disposed externally of said crankcase, said restrictor comprising a passageway fluidly communicating said crankcase and said chamber.

23. An internal combustion engine, comprising:

an engine housing including a crankcase and at least one cylinder;

a crankshaft rotatably disposed within said engine housing;

a connecting rod and piston corresponding to each said cylinder, each said connecting rod connected to said crankshaft and each said piston reciprocable within a respective cylinder to generate positive and negative pressure pulses within said crankcase during cranking and running speeds of said engine;

a carburetor; and a priming system, comprising:

a chamber in fluid communication with said crankcase through a restrictor, said chamber also in fluid communication with said carburetor through a one-way valve permitting fluid flow from said chamber to said carburetor, said restrictor dimensioned to allow substantial pressure equalization between said crankcase and said chamber at engine cranking speeds and to prevent substantial pressure equalization between said crankcase and said chamber at engine running speeds;

whereby at engine cranking speeds, positive pressure pulses may pass from said chamber to said carburetor through said one-way valve, and at engine running speeds, said positive pressure pulses are substantially absent within said chamber.

24. The engine of claim 23, wherein said carburetor includes a fuel bowl containing a quantity of fuel with an air space above the fuel, said chamber in fluid communication with said air space, whereby at engine cranking speeds, said positive pressure pulses pass into said air space and pressurize said air space.

25. The engine of claim 23, wherein said chamber is one of:

disposed within said crankcase, said restrictor comprising a restriction orifice between said crankcase and said chamber; and disposed externally of said crankcase, said restrictor comprising a passageway fluidly communicating said crankcase and said chamber.

* * * * *